US006170680B1

(12) United States Patent
Hung

(10) Patent No.: US 6,170,680 B1
(45) Date of Patent: Jan. 9, 2001

(54) RACK FOR HOLDING HAIRDRESSING TOOLS

(76) Inventor: Chih-Chiang Hung, No. 11 Ming Shen E. Road, Sec. 2, Taipei (TW)

( * ) Notice: Under 35 U.S.C. 154(b), the term of this patent shall be extended for 0 days.

(21) Appl. No.: 09/417,849

(22) Filed: Oct. 14, 1999

(51) Int. Cl.[7] ..... D06F 53/00
(52) U.S. Cl. ..... 211/119.007
(58) Field of Search ..... 211/119.007, 88.01, 211/86.01, 133.6, 189; 248/339; 297/188.2

(56) References Cited

U.S. PATENT DOCUMENTS

| | | | | |
|---|---|---|---|---|
| 2,831,598 | * | 4/1958 | Slavsky et al. | 211/88.01 |
| 2,932,544 | * | 4/1960 | Lambert | 211/88.01 |
| 3,145,848 | * | 8/1964 | Wood | 211/88.01 |
| 3,986,649 | * | 10/1976 | Heimstra | 211/88.01 |

* cited by examiner

*Primary Examiner*—Alvin Chin-Shue
*Assistant Examiner*—Sarah Purol
(74) *Attorney, Agent, or Firm*—Dougherty & Troxell

(57) ABSTRACT

A rack for holding hairdressing tools including a U-shaped shelf that is detachably connected to and behind a back of a chair intended for hairdressing by means of connectors. The shelf includes several compartments for holding different hairdressing tools and is so sized and curved that an inner wall thereof is suitable for closely locating behind the back of a hairdressing chair. The connectors are connected to the inner wall of the shelf at suitable positions and each includes a supporting arm for supporting the shelf thereon, a clamping arm, and an elastic pressing plate. The clamping arms and the pressing plates cooperate with one another to clamp the back of the chair between them, so that the shelf is connected to and behind the back without occupying additional room and located at a height that allows a hairdresser to get the tools in the shelf without bending frequently.

2 Claims, 6 Drawing Sheets

RACK FOR HOLDING HAIRDRESSING TOOLS

BACKGROUND OF THE INVENTION

The present invention relates to a hairdressing tool rack, and more particularly to a shelf that includes compartments for holding hairdressing tools and can be connected to and behind a back of a hairdressing chair, so that various hairdressing tools can be easily accessed without occupying additional space in a room.

Many equipment and tools designed for hairdressing have been largely improved in their material, appearance and structure to provide better functions. For example, the clumsy and heavy lounge-type hairdressing chair in early stage has been replaced by a light chair that meets the requirements of body engineering. And, the one-leg stand having a round tray connected to a top thereof for holding hairdressing tools has been replaced by a cart having multiple layers of open trays to hold more tools in a stable manner. However, such cart for holding hairdressing tools still has following disadvantages that need to be improved:

1. A hairdresser has to bend frequently to get tools positioned on trays that are located at a lower portion of the cart, and this is apparently inconvenient for the hairdresser; and
2. It is necessary to have the cart stay close to the hairdressing chair so that the hairdresser may easily get the tools on the cart during work. And, the cart would inevitably occupy considerable space and even hinder the hairdresser from working.

It is therefore tried by the inventor to develop a hairdressing tool holding means to eliminate the drawbacks existing in the conventional hairdressing tool holding cart.

SUMMARY OF THE INVENTION

A primary object of the present invention is to provide a rack that can be closely attached to a hairdressing chair for holding tools needed in hairdressing without occupying additional space in a room while a hairdresser may easily get the tools from the rack without bending frequently.

To achieve the above and other objects, the rack of the present invention mainly includes a U-shaped shelf that is detachably connected to and behind a back of a hairdressing chair by means of connectors. The shelf includes several compartments for holding different hairdressing tools and is so sized and curved that an inner wall thereof is suitable for closely locating behind the back of the hairdressing chair. The connectors are attached to the inner wall of the shelf at suitable positions and each includes a supporting arm for supporting the shelf thereon, a clamping arm, and an elastic pressing plate. The clamping arms and the pressing plates cooperate with one another to clamp the back of the chair between them, so that the shelf is connected to and behind the back without occupying additional room and located at a height that allows a hairdresser to get the tools in the shelf without bending frequently.

BRIEF DESCRIPTION OF THE DRAWINGS

The objects, the features, and the functions of the present invention can be best understood by referring to the following detailed description of the preferred embodiments and the accompanying drawings, wherein.

DETAILED DESCRIPTION OF THE PREFERRED EMBODIMENTS

Figure 1:
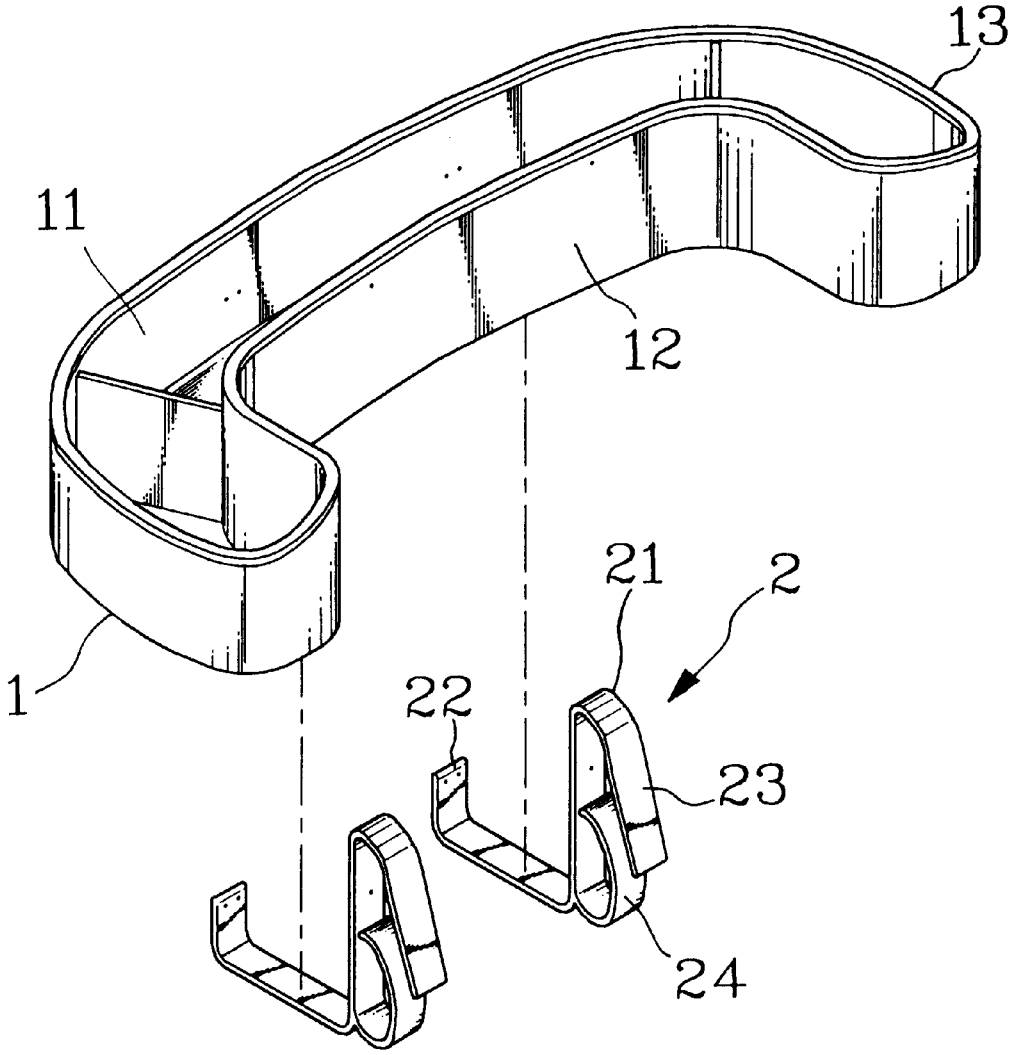
FIG. 1 is an exploded perspective of a rack for holding hairdressing tools according to the present invention.
Figure 2:
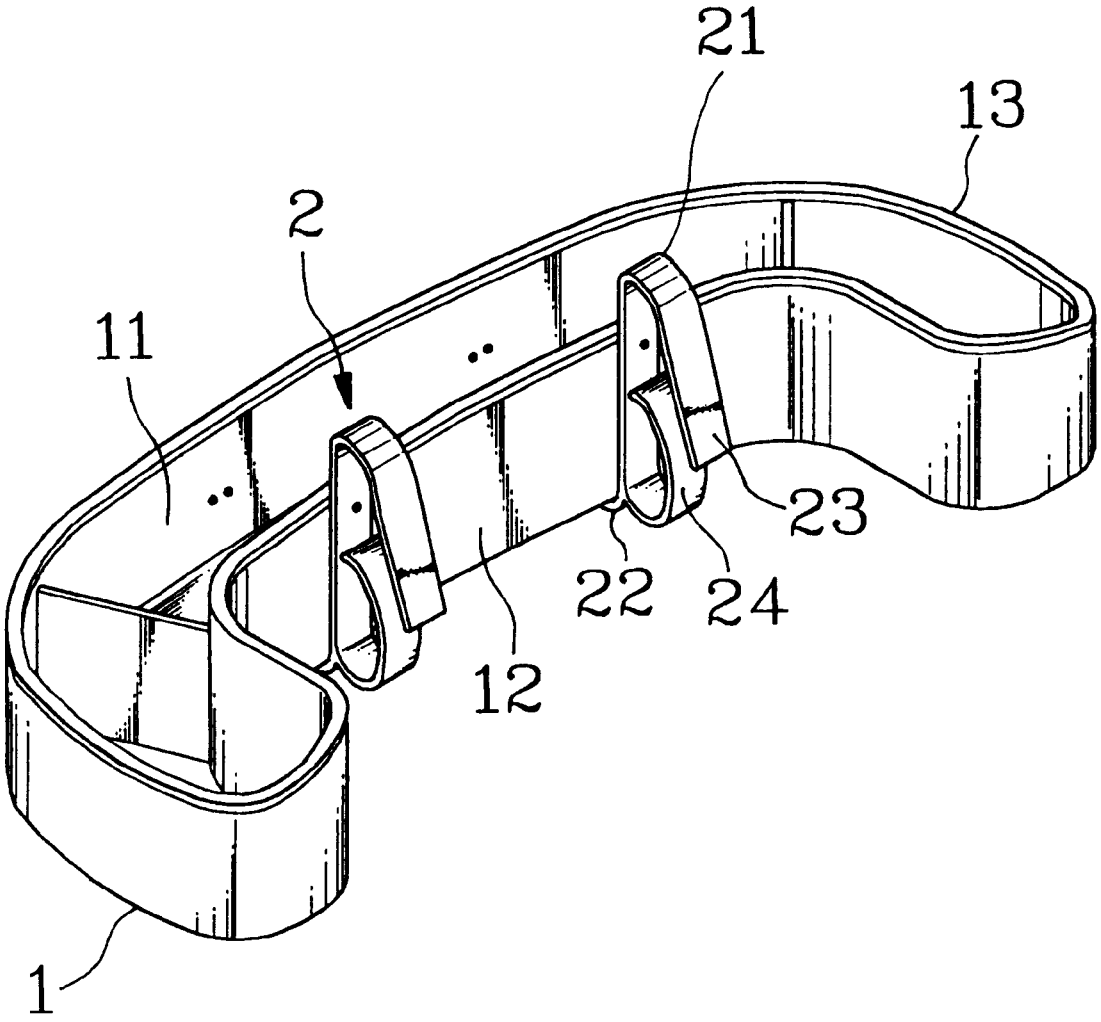
FIG. 2 is an assembled perspective of the rack of FIG. 1.

Please refer to FIGS. 1 and 2 that are exploded and assembled perspective views, respectively, of a rack for holding hairdressing tools according to the present invention. As shown, the rack mainly includes a substantially U-shaped shelf 1 and connectors 2.

The shelf 1 defines an inner space that may be partitioned into several compartments 11 depending on actual need, so that different tools may be separately positioned in these compartments 11. The U-shaped shelf 1 is so sized and curved that a middle section thereof extends an overall width of a back 31 of a hairdressing chair 3 and an inner wall 12 thereof may be closely positioned behind the back 31 of the chair 3.

The connectors 2 are designed for attaching to the middle section of the shelf 1 at suitable positions and thereby detachably connecting the shelf 1 to the back 31 of the chair 3. The connector 2 each includes a vertical central plate 21, a supporting arm 22 horizontally extended from a lower end of the central plate 21 and having an upward extended free end, a clamping arm 23 inclinedly extended downward from an upper end of the central plate 21 in a direction opposite to the supporting arm 22, and a curved elastic pressing plate 24 upward extended from the lower end of the central plate 21 opposite to the supporting arm 22. The pressing plate 24 partially faces an inner side of the clamping arm 23 and there is an opening between the pressing plate 24 and the clamping arm 23. As shown in FIG. 2, when the connectors 2 are attached to the shelf 1, the supporting arms 22 fitly support a bottom of the middle section of the shelf 1.

Figure 3B:
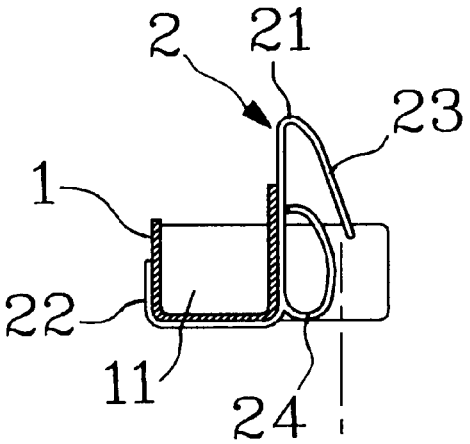
FIGS. 3A and 3B illustrate the manner of connecting the rack of the present invention to and behind a back of a chair.
Figure 3A:
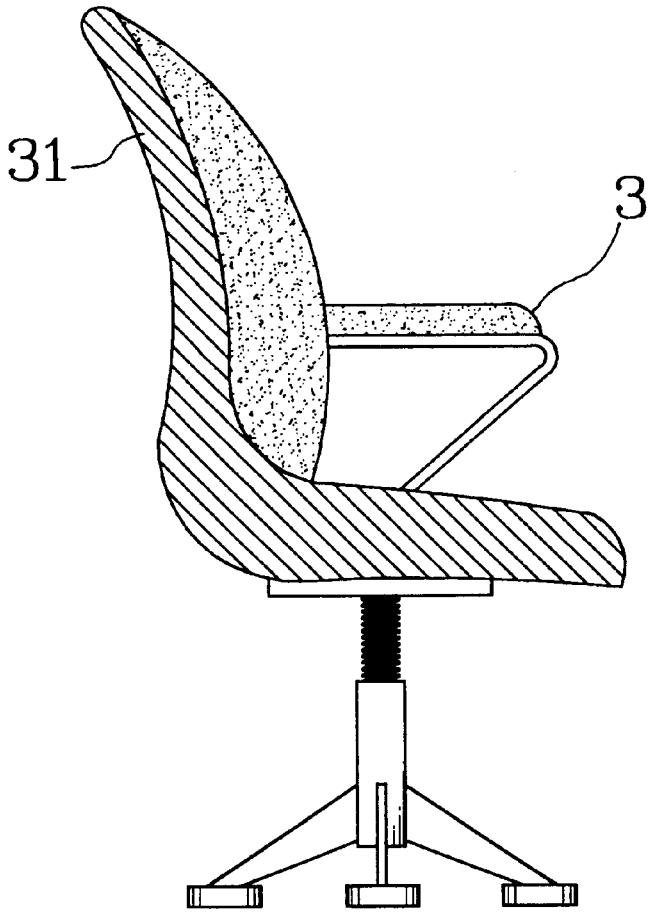
Figure 4:
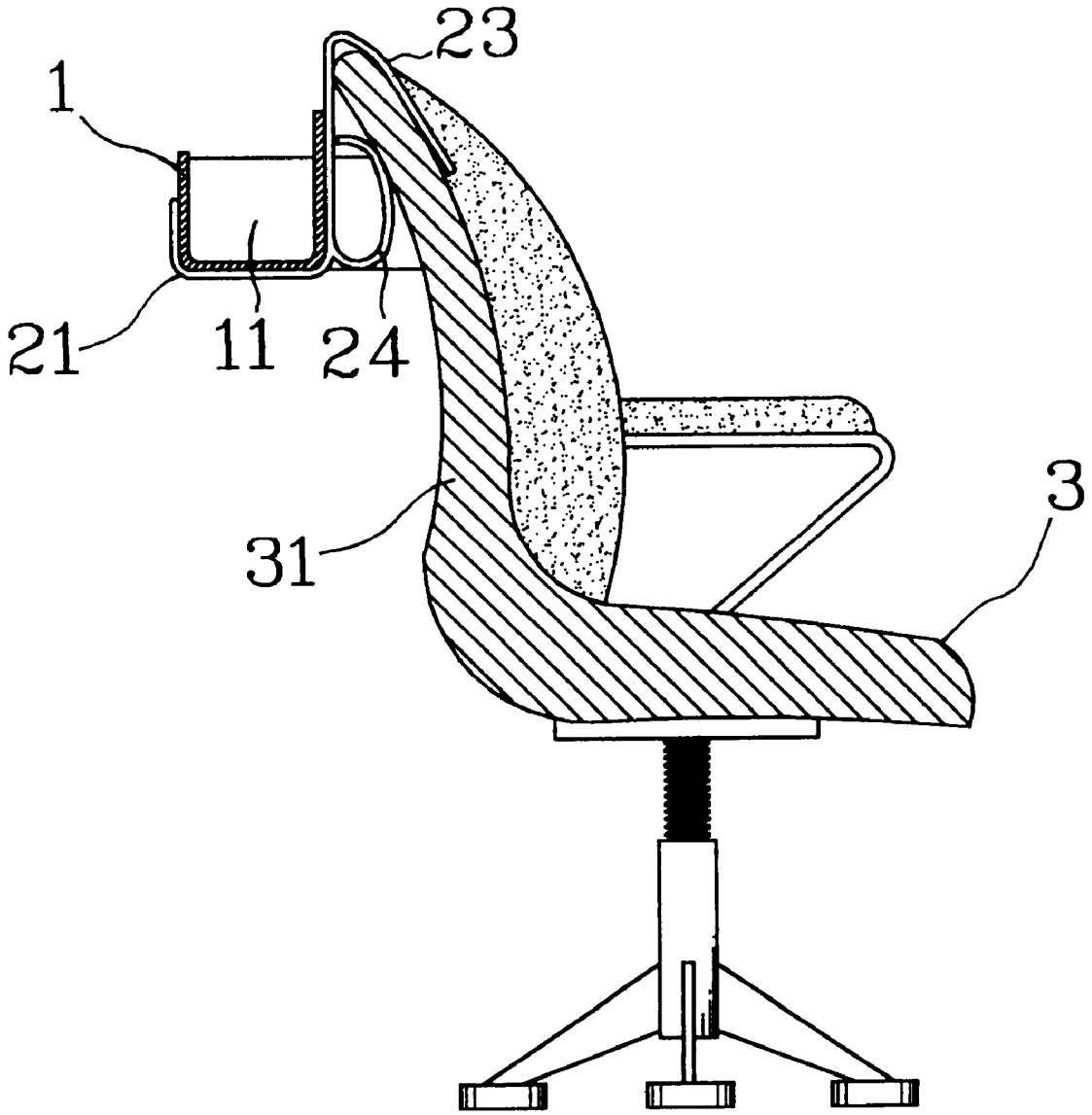
FIG. 4 is a side view showing the rack of the present invention connected to and behind the back of a chair.
Figure 5:
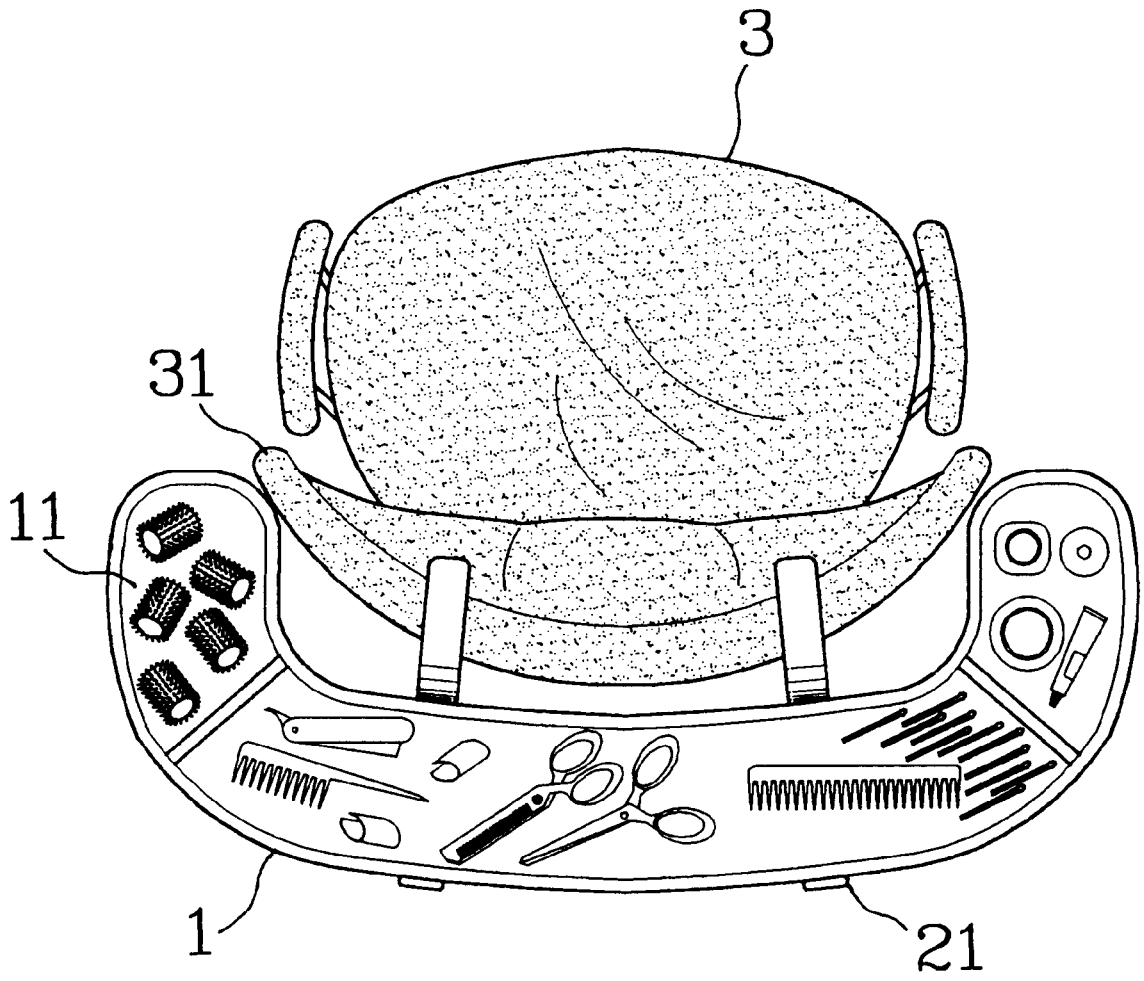
FIG. 5 is a top view showing the rack of the present invention connected to the back of a chair.

As shown in FIGS. 3A, 3B and 4, the rack for holding hairdressing tools of the present invention is intended for directly clamping to the back 31 of the chair 3 without occupying additional space in the room of a beauty parlor. To connect the rack of the present invention to the back 31 of the chair 3, first hold the shelf 1 a little above and behind the back 31 of the chair 3, so that the inner wall 12 would face a backside of the back 31 and the back 31 would locate between two side sections of the U-shaped shelf 1. Then, move the shelf 1 downward until the two connectors 2 contact with a top of the back 31. At this point, align the openings between the clamping arms 23 and the pressing plates 24 with the back 31 and push the whole rack downward, so that the two clamping arms 23 and the two pressing plates 24 tightly clamp the back 31 between them. The shelf 1 supported on the supporting arms 22 is therefore attached to the back 31 of the chair 3 through the connectors 2, as shown in FIG. 5.

The rack attached to the back 31 of the chair 3 is now located at a height suitable for work according to the body engineering. A hairdresser could get the hairdressing tools from the rack in a more comfortable and more convenient manner without the need of bending his or her body frequently. And, the rack may be conveniently detached from one back 31 and mounted to a back 31 of another chair 3 at any time.

Figure 6:
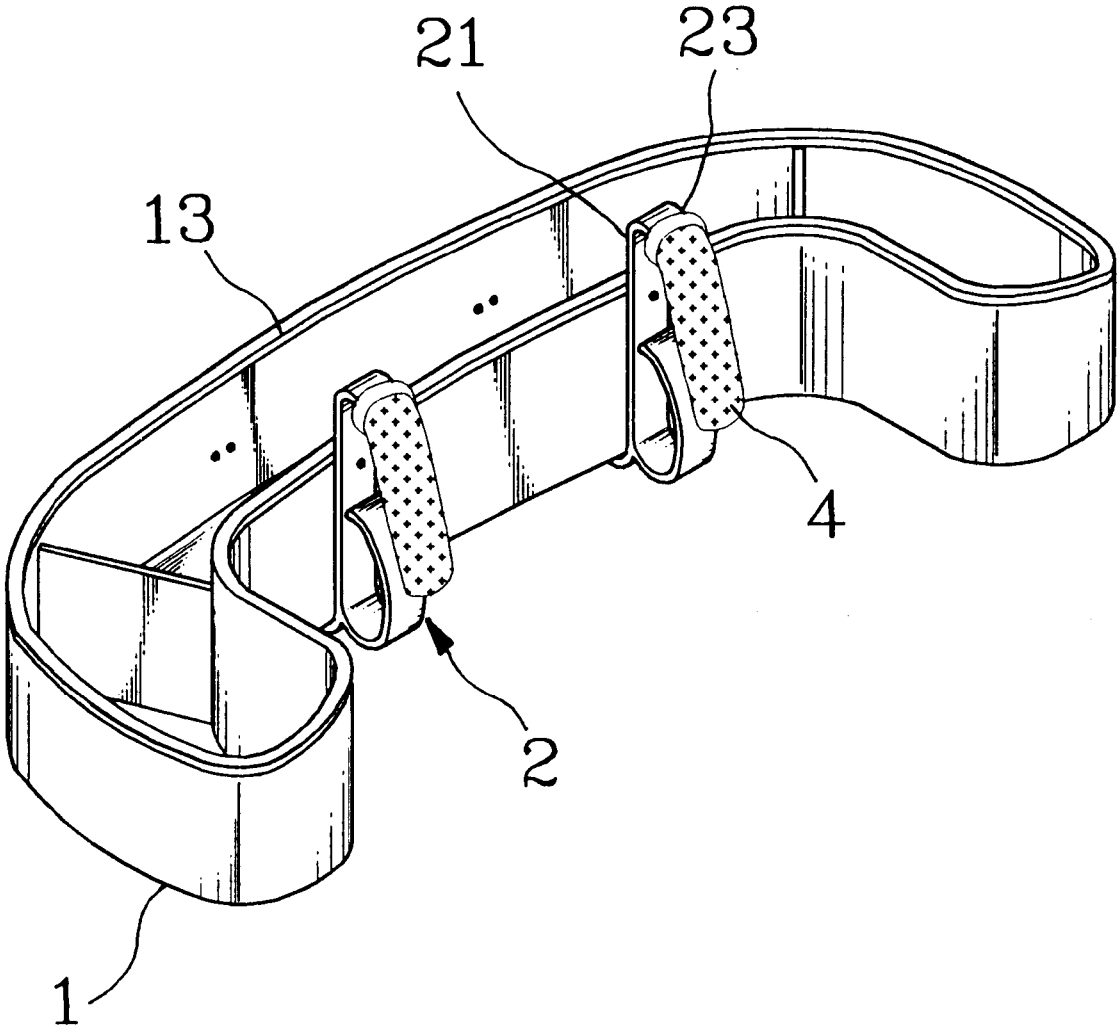
FIG. 6 shows the rack of the present invention with two clamping arms thereof covered by soft material to avoid damaging the back.

Please refer back to FIG. 1. To prevent the connectors 2 from damaging a surface material of the back 31, any part of each of the connectors 2 that would get in contact with the back 31 is either rounded or chamfered. Moreover, the clamping arms 23 may be covered with soft material, such as resilient rubber sleeves 4 as shown in FIG. 6, to ensure the protection of the surface material of the back 31. On the other hand, to protect the hairdresser against burrs on the shelf 1, a hand-protecting boarder 13 may be provided along an upper edge of the shelf 1, as shown in FIG. 1. Such hand-protecting boarder 13 also enhances the appearance of the shelf 1.

What is to be noted is the form of the present invention shown and disclosed is to be taken as a preferred embodiment of the invention. Various changes in the shape, size, and arrangements of parts may be resorted to without departing from the spirit of the invention or the scope of the subjoined claims.

What is claimed is:

1. A rack for holding hairdressing tools, comprising a substantially U-shaped shelf and connectors for detachably connecting said shelf to said back of said chair;

said shelf defining an inner space that is divided into several compartments for accommodating different hairdressing tools, said shelf being so sized and curved that two side sections and a middle section thereof together define an inner wall that is suitable for closely locating behind a back of a chair intended for hairdressing; and each of said connectors including a central plate, a supporting arm at one side of said central plate for supporting said shelf thereon, a clamping arm downward extended from an upper end of another side of said central plate, and a curved elastic pressing plate upward extended from a lower end of said central plate to partially face an inner side of said clamping arm; said connectors being separately connected to said inner wall of said shelf at predetermined positions;

whereby said shelf may be easily detachably attached to and behind said back of said chair by clamping said back between said clamping arms and said pressing plates of said connectors.

2. A rack for holding hairdressing tools as claimed in claim 1, wherein said connectors are provided at all areas that contact with said back of said chair with rounded or chamfered corners and/or edges, and said clamping arms are covered with soft material to avoid damaging any surface material of said back of said chair.

* * * * *